United States Patent [19]

Ashley et al.

[11] Patent Number: 5,058,651

[45] Date of Patent: Oct. 22, 1991

[54] ROLLER DOOR ASSEMBLIES

[75] Inventors: Paul Ashley; John U. Chapman, both of Carlisle, England

[73] Assignee: Clark Door Limited, Carlisle, England

[21] Appl. No.: 462,314

[22] Filed: Dec. 22, 1989

Related U.S. Application Data

[63] Continuation of Ser. No. 61,697, Jun. 12, 1987, abandoned.

[30] Foreign Application Priority Data

Oct. 15, 1986 [GB] United Kingdom ..... 8624735

[51] Int. Cl.[5] ..... E06B 9/17

[52] U.S. Cl. ..... 160/271

[58] Field of Search ..... 160/271, 272, 273.1, 160/133, 23.1, 268.1, 269, 270

[56] References Cited

U.S. PATENT DOCUMENTS

| | | | |
|---|---|---|---|
| 2,845,117 | 7/1958 | Barry | 160/269 |
| 3,149,665 | 9/1964 | Handford | 160/272 X |
| 4,478,268 | 10/1984 | Palmer | 160/272 X |
| 4,601,320 | 7/1986 | Taylor | 160/271 |
| 4,690,195 | 9/1987 | Taylor | 160/133 X |
| 4,934,437 | 6/1990 | Kraeutler | 160/271 X |

FOREIGN PATENT DOCUMENTS

| | | | |
|---|---|---|---|
| 2093895 | 9/1982 | United Kingdom | 160/269 |

*Primary Examiner*—David M. Purol

*Attorney, Agent, or Firm*—Rogers, Howell & Haferkamp

[57] ABSTRACT

A roller door assembly comprises a roller door having on its vertical edges spaced restraining members, and guides at each edge of the door including opposing members forming a gap therebetween. The restraining members are on one side of the gap with the door on the other side thereof, whereby upto a desired pressure or force on the door the restraining members cannot pass through said gaps but at said desired pressure or force the restraining members are compressed and/or the gap expends for the restraining members to pass through said gaps to release the door.

14 Claims, 2 Drawing Sheets

ROLLER DOOR ASSEMBLIES

This application is a continuation of application Ser. No. 07/061,697, filed June 12, 1987 now abandoned.

This invention concerns roller door assemblies.

Roller doors are often used to close large openings in garage, warehouse and factory situations, where space may be usefully saved. Such roller doors of continuous sheet or slatted construction are attached to a roller positioned horizontally over a door opening so that opening and closing of the door is by vertical movement thereof. The edges of such doors usually run in guides but increased pressure on the door such as in higher than average wind speeds can cause the door to bow and its edges to come out of the guides. The door can then flap about dangerously.

Proposals have been made for providing restraining members on the edges of such doors that cannot pass through the guides. A problem with these is that under very high pressure conditions such as wind speeds approaching gale force or upon impact by a vehicle, the door restraining members hold the door in place but only at the risk of damage to the door such as by tearing.

The object of this invention is to provide a roller door assembly that eliminates or at least mitigates the aforementioned disadvantage.

According to the invention there is provided a roller door assembly wherein vertical edges of the door have restraining means thereon whereby upto a desired pressure or force on the door the restraining means cannot pass through gaps at the edges of the door but at said pressure or force the restraining means are compressed and/or the gap expands for the restraining means to pass through said gaps to release the door.

The preferred restraining means is compressible and may be solid or hollow. Rubber, elastomeric or plastics rod or tubing are suitable materials for the restraining means. The restraining means may also be of multipart form, such as in two parts, the parts being attached to edges of the door to present a generally smooth, say curved, surface towards the faces of the gap. Suitable plastics materials for the restraining means include PTFE, nylon, polyethylene and similar materials. Thus, up to a certain force or pressure on the door, as it bows or distorts, the restraining means are pulled towards the gaps but are too large to pass through the gaps. However, above a certain pressure the distortion or bowing of the roller door will be such that the restraining means are pulled into the gaps and compressed so that they pass through the gaps.

Alternatively or additionally, the gaps may be provided by two facing members, say V-shaped, of resiliently deformable material, whereby up to a certain pressure on the door, the restraining means are retained, but above that pressure the facing members deform and optionally the restraining means are compressed, whereby the restraining means escape through the gaps.

The roller doors of the invention may have as many such restraining means on each side edge thereof as desired. The size of the door will probably be the main factor in the selection of the number and positions of the restraining means.

The size of the restraining means and its compressibility and optionally the deformability of the members forming the gaps may also be important factors in their selection depending, for example, on how much force or pressure the roller door is intended to withstand before the restraining means are released past the gap.

The invention is particularly concerned with continuous sheet roller doors and so another factor that may be of importance is the strength of the material used for the door. A preferred material is polyester fabric, such as of the type used for conveyor belting but obviously other suitable materials may be used for the doors of the invention, such as polyvinyl chloride.

It is proposed that for a polyester roller door wind speeds of up to 80 m.p.h. equivalent to a force of 0.15 lb/sq inch, preferably up to 60 m.p.h. equivalent to a force of 0.063 lb/sq inch, be accommodated without the release of the restraining means but that above such a force the restraining means be released past the gap. In this way damage such as tearing of the door may be eliminated or at least instances thereof reduced.

This invention will now be further described, by way of example only, with reference to the accompanying drawings, in which.

Figure 1:
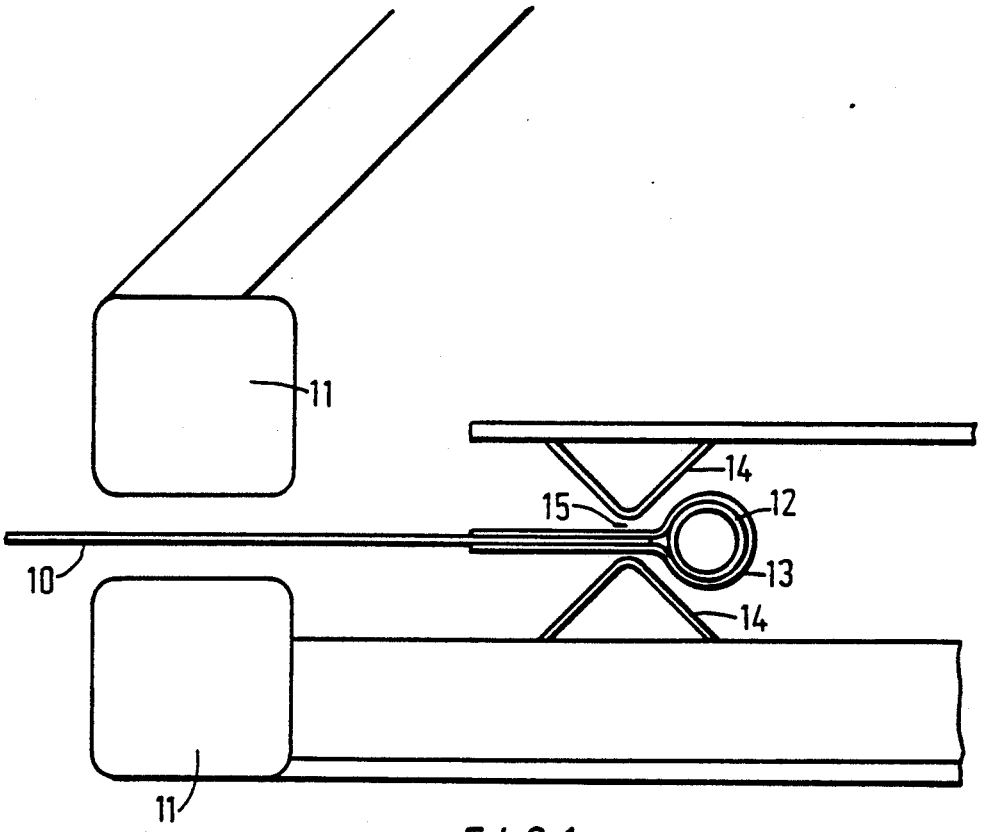
FIG. 1 is a horizontal section through one side of a roller door assembly.
Figure 2:
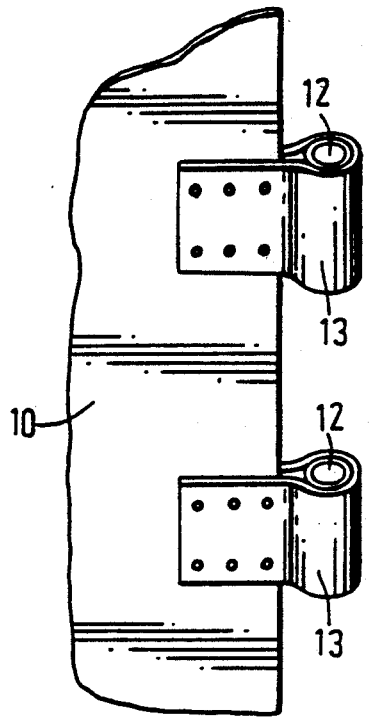
FIG. 2 shows part of an edge portion of the roller door of FIG. 1.

Referring to FIGS. 1 and 2 of the drawings, a continuous roller door 10 of say polyester material, such as of the type used in the manufacture of conveyor belts is attached at its upper edge to a roller (not shown) on which the door rolls up as it opens. When the door 10 is being closed the edge portions of the door run between support posts 11 each faced with wear resistant material.

At the extreme edges of the door are attached at spaced intervals pieces of rubber tubing 12 by means of pieces 13 of polyester material wrapped therearound and rivetted to the edges of the door.

The rubber tubing pieces are outward of vertical facing V-shaped guides 14 that form between them a narrow opening 15. The guides 14 may be slightly resiliently deformable.

Figure 3:
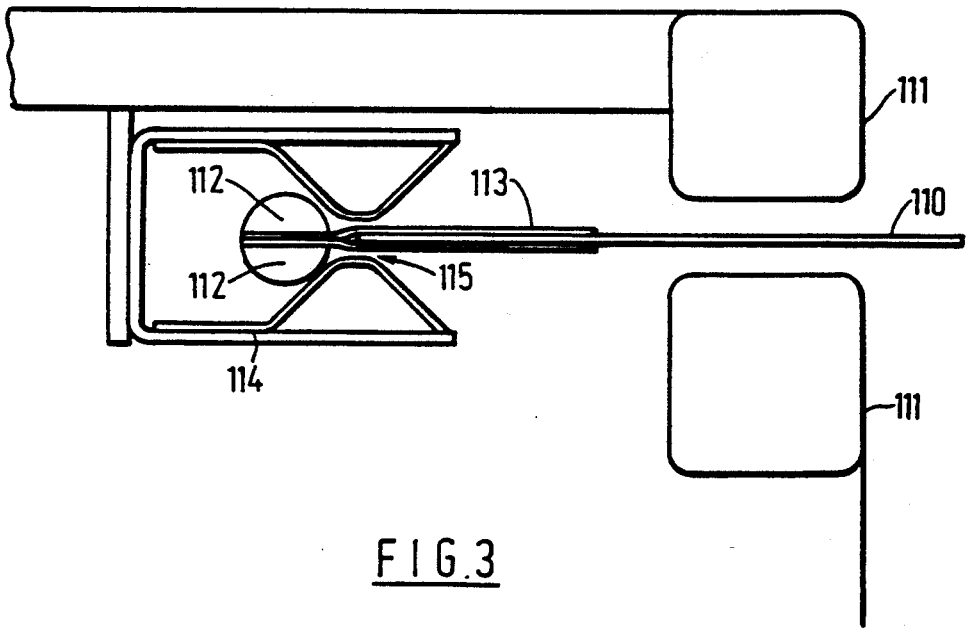
FIG. 3 is a horizontal section through one side of an alternative roller door assembly.
Figure 4:
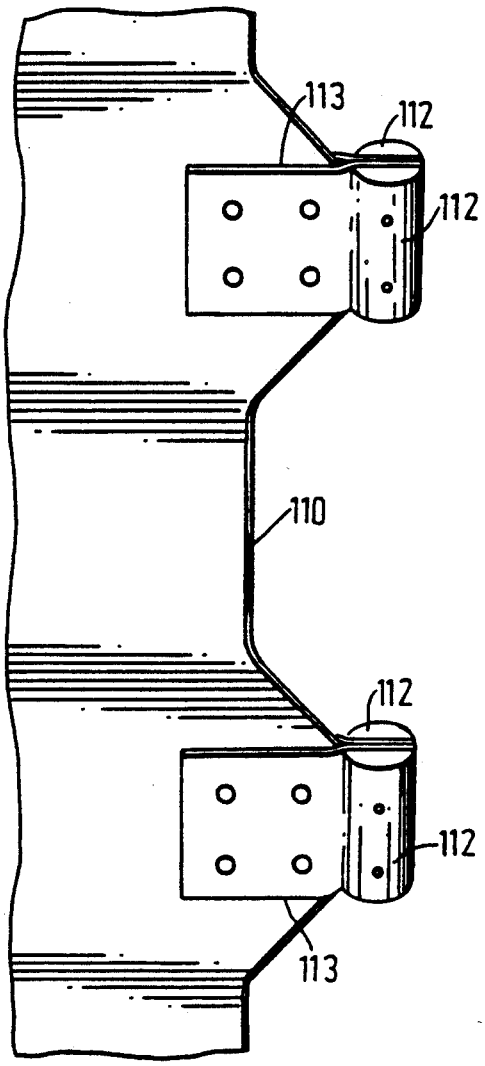
FIG. 4 shows part of an edge portion of the roller door of FIG. 3.

Turning to FIGS. 3 and 4, a continuous roller door 110 of polyester material is attached at its upper edge to a roller not shown on which the door rolls up as it opens. When the door 110 is being closed the edge portions of the door runs between supports posts 111 each faced with wear resistant material.

At extreme edges of the door are rivetted at spaced intervals pieces 113 of polyester material one each side of the door, the pieces 113 extending beyond the edges of the door. On each side of said pieces is attached a plastics pieces 112 of semi-circular section, a pair of said pieces together forming a generally circular section restraining means.

The restraining means are outward of vertical facing V-shaped guides 114 that form between them a narrow opening 115. The guides 114 may be slightly resiliently deformable. An advantage of the embodiment of FIGS. 3 and 4 is that as the restraining means presents generally smooth surfaces to the guides friction is reduced and hence loads on motors for raising and lowering the door are reduced.

The doors of both the illustrated embodiments operate in the same fashion. Under conditions when there is little or no wind or other pressure on the closed door these guides play no part in the operation of the door. However, in stronger winds or pressure say up to about 80 m.p.h. (0.15 lb/sq in), preferably only up to 60 m.p.h. (0.063 lb/sq inch.) the door will bow and the rubber or plastics tubing pieces will abut against the V-shaped guides to hold the door in place.

If the pressure on the door is greater than about 0.15, preferably 0.063 lb/sq in such as in wind speeds greater than 80 m.p.h. preferably 60 m.p.h. or upon impact of a vehicle, that pressure will cause the rubber tubing or plastics pieces to be compressed against the guides and so the resultant bowing of the roller door pulls the rubber tubing or plastics pieces into the guides with sufficient force to compress the tubing or plastics pieces and possibly also deform the guides 14 slightly so that the tubing or plastics pieces pass through the narrow gap between the guides. This releases the roller door and allows it to bow or distort according to the force applied so that damage, such as tearing is avoided.

We claim:

1. A roller door assembly comprising:

a roller door having opposed generally vertical edges;

a plurality of spaced restraining means disposed on each of said opposed vertical edges and spaced at longitudinal intervals along the edge of said door; and guide means at each edge of the door, including opposing members forming a gap therebetween, said restraining means being on one side of the gap and said door being on the other side thereof, whereby below a desired force on the door, said restraining means cannot pass through said gap but at and above said desired force said restraining means can pass through said gap to release the door.

2. A door assembly as claimed in claim 1, wherein at least one of said guide means and said restraining means is deformable.

3. A roller door assembly as claimed in claim 1, wherein said restraining means are compressible.

4. A roller door assembly as claimed in claim 1, wherein said guide means are resiliently deformable.

5. A roller door assembly as claimed in claim 1 wherein said restraining means are of tubing.

6. A roller door assembly as claimed in claim 1 wherein said restraining means are of solid material.

7. A roller door assembly as claimed in claim 1 wherein said guide means opposing members are substantially V-shaped members which are spaced apart to form said gap.

8. A roller door assembly as claimed in claim 1 wherein said door is made of polyester fabric.

9. A roller door assembly as claimed in claim 1 wherein said door is made of polyvinyl chloride.

10. A roller door as claimed in claim 1 wherein said door is made of flexible plastic.

11. A roller door as claimed in claim 10 wherein said restraining means are of tubing.

12. A roller door as claimed in claim 10 wherein said restraining means are of solid material.

13. A roller door assembly as claimed in claim 1 wherein:

the plurality of restraining means are secured along spaced segments of the opposed vertical edges of the roller door, the spaced segments and restraining means are separated by the longitudinal intervals along the opposed vertical edges of the roller door, and the longitudinal intervals have a length at least as long as the segments of the vertical edges of the roller door.

14. A roller door assembly comprising:

a roller door adapted to be raised and lowered in a doorway by being respectively rolled and unrolled from a horizontal rotating roller over the doorway, the roller door having opposite longitudinal side edges that are generally vertical when the roller door is unrolled;

a plurality of separate restraining means secured along spaced segments of the opposite longitudinal side edges of the roller door, the spaced segements and restraining means being spaced at longitudinal intervals along the side edges of the roller door, the longitudinal intervals having a length at least as long as the segments of the side edges; and, guide means adapted to extend vertically at opposite longitudinal side edges of a doorway, the guide means each including a pair of mutually opposed members with a gap formed therebetween, the gaps separating a first side and a second side of the guide means, the plurality of restraining means being positioned on the first sides of the guide means and the roller door extending through the gaps and being positioned on the second sides of the guide means, the guide means preventing passage of the plurality of restraining means from the first sides of the guide means through the gaps to the second sides of the guide means when a lateral pulling force up to a predetermined lateral pulling force is exerted on the restraining means, and the guide means being adapted to enable the passage of the plurality of restraining means from the first sides of the guide means through the gaps to the second sides of the guide means when a lateral pulling force above the predetermined lateral force is exerted on the restraining means.

* * * * *